United States Patent [19]

van den Brink et al.

[11] 4,026,702

[45] May 31, 1977

[54] PHOTOCONDUCTIVE ELEMENT HAVING A LAYER INCLUDING A PHOTOCONDUCTIVE CADMIUM COMPOUND AND HYDROPHOBIC COLLOIDAL SILICA

[75] Inventors: Michiel van den Brink, Venlo; Andreas C. Stoot, Blerick, both of Netherlands

[73] Assignee: Oce-van der Grinten N.V., Venlo, Netherlands

[22] Filed: Nov. 28, 1975

[21] Appl. No.: 636,201

[30] Foreign Application Priority Data

Nov. 28, 1974 United Kingdom ..... 51620/74

[52] U.S. Cl. ..... 96/1.5; 252/501; 338/15

[51] Int. Cl.[2] ..... G03G 5/04

[58] Field of Search ..... 96/1.5; 252/501; 313/94; 338/15

[56] References Cited

UNITED STATES PATENTS

| | | | |
|---|---|---|---|
| 3,041,169 | 6/1962 | Wielicki | 96/1.5 |
| 3,244,639 | 4/1966 | Mindick et al. | 252/501 X |
| 3,477,847 | 11/1969 | Becquerol | 96/1.5 X |
| 3,607,255 | 9/1971 | Back | 96/1.5 X |
| 3,674,477 | 7/1972 | Carlson | 96/1.5 X |
| 3,772,013 | 11/1973 | Wells | 96/1.5 X |
| 3,775,103 | 11/1973 | Sadamatsu et al. | 96/1.5 X |
| 3,782,932 | 1/1974 | Tulagin | 96/1.5 X |
| 3,865,587 | 2/1975 | Noe | 96/1.5 |
| 3,867,139 | 2/1975 | Yamada et al. | 96/1.5 X |
| 3,907,558 | 9/1975 | Kropac | 96/1.5 X |

FOREIGN PATENTS OR APPLICATIONS

| | | | |
|---|---|---|---|
| 702,102 | 1/1965 | Canada | 96/1.5 |
| 1,497,141 | 4/1969 | Germany | 96/1.5 |
| 39-27575 | 12/1964 | Japan | 96/1.5 |

*Primary Examiner*—Edward C. Kimlin
*Assistant Examiner*—Judson R. Hightower
*Attorney, Agent, or Firm*—Albert C. Johnston

[57] ABSTRACT

The electrophotographic properties of photoconductive elements sensitized by a cadmium sulfide-binder layer are improved by incorporating hydrophobic colloidal silica in the photoconductive layer.

5 Claims, No Drawings

PHOTOCONDUCTIVE ELEMENT HAVING A LAYER INCLUDING A PHOTOCONDUCTIVE CADMIUM COMPOUND AND HYDROPHOBIC COLLOIDAL SILICA

This invention relates to a photoconductive element comprising a support and a photoconductive layer which contains a photoconductive cadmium sulphide, cadmium selenide or cadmium sulphoselenide dispersed in an organic polymeric binder. Such photoconductive layers are generally known as cadmium sulphidebinder layers.

Although cadmium sulphide-binder layers of the type under consideration have been proposed many times they are scarcely put in practice of electrophotography, perhaps on account of some disadvantages if compared with commonly used photoconductive layers such as zinc oxide-binder and selenium layers. For example, depending on the concentration of cadmium sulphide in the binder, the photoconductive layer either shows a rather high dark decay after charging or a rather high residual voltage after charging and exposure. In addition if a latent electrostatic image on a cadmium sulphide-binder layer is developed by liquid development or an edge-only development method such as cascade development the background becomes somewhat specked as it does not remain completely free from developer powder, and if the latent electrostatic image is developed by a solid area development method such as magnetic brush development the image parts are not homogeneous but show a grained structure.

It has now been found that the disadvantages mentioned above can be eliminated or at least diminished by incorporating a colloidal hydrophobic silica in the photoconductive layer. According to the present invention there is provided a photoconductive element which comprises a support carrying a photoconductive layer, the layer comprising a photoconductive cadmium sulphide, cadmium selenide or cadmium sulphoselenide dispersed in an organic polymeric binder and a hydrophobic colloidal silica.

The silica content of the photoconductive layer is not critical. In general quantities of about 2% to 6% by weight of hydrophobic colloidal silica calculated on the weight of the cadmium compound are quite satisfactory. If the silica content is decreased below 2% or above 6% the results are still favourable but less pronounced.

Particles are considered to be of colloidal size if their particle size is between 1 and 1000 nanometer, but usually the average particle size of colloidal silica is between about 7 and 100 nanometer. Such a silica can be made hydrophobic by converting the hydroxyl groups at the surface of the particles into hydrophobic groups such as alkyl, aryl, alkoxy or aryloxy groups. The conversion may be performed by treating the particles with halogen silanes, halogen siloxanes, aldehydes, alcohols or other compounds which react with the hydroxyl groups of the silica. The commercially available hydrophobic colloidal silicas are usually methylated.

It is remarkable that the most common hydrophilic colloidal silicas cannot be used in the photoconductive element according to the invention as these products introduce unfavourable electrophotographic properties.

Each cadmium sulphide, selenide or sulphoselenide suitable for use in electrophotography may be used in the photoconductive element according to the invention; for example, a cadmium sulphide doped with an activator such as a copper, silver or gold compound and a co-activator such as a halide or an aluminium, gallium or indium compound.

The support of the photoconductive element may be composed of metal, plastic or paper and, if required, it can be set at the desired resistivity by means of conducting or insulating additives. If necessary, the support may be coated with a barrier layer, anchoring layer or conductive layer such as a plastic or metallic layer or a layer containing a plastic and a conducting substance, such as a carbon containing cellulose acetate butyrate layer. The photoconductive layer can be formed from a dispersion of the cadmium sulphide in a binder that is suitable for being employed in the electrophotographic process. Suitable binders are, e.g., polystyrene, polyacrylates and polymethacrylates, chlorinated rubber, vinyl polymers such as polyvinyl acetate and polyvinyl chloride, cellulose esters and cellulose ethers, alkyd resins, epoxy resins, silicon resins, as well as copolymers and mixtures of these products, such as a mixture of polyvinyl acetate and a styrene ethyl acrylate copolymer. Photoconductive binders, such as polyvinyl carbazole, which may be used in the form of a donor-acceptor complex with products such as trinitrofluorenone, can also be used. The weight ratio cadmium sulphide: binder is usual for cadmium sulphide-binder layers. In general good results are obtained with weight ratios between 7 : 1 and 1 : 1.

When employed in indirect electrophotographic processes the photoconductive element containing the cadmium sulphide according to the invention may be used in embodiments that are also suitable for other photoconductors. Useful are, e.g., the shape of a drum or a finite belt that is drawn from a roll and, after use, is reeled on a second roll, or the form of an endless belt such as the zigzag-folded belt described in U.S. Pat. No. 3,926,625.

The electrophotographic process applied to the photoconductive element according to the invention may be any usual indirect electrophotographic process in which a transferable image is produced on the photoconductive element and the image is transferred to a sheet of receiving material and fixed on the latter. In these processes the transferable image is a toner image or a latent electrostatic image. The toner image may be obtained, for example, by developing a conductivity image resulting from imagewise exposure of the photoconductive layer, or by developing a latent electrostatic image resulting from charging and imagewise exposure. In processes in which a latent electrostatic image is transferred, the latent image is usually formed by charging and imagewise exposure and thereupon transferred to a sheet of receiving material and developed on the latter.

The invention is further illustrated in the following Examples.

EXAMPLE 1

A dispersion having the following composition was prepared:

2.5 g of cadmium sulphide doped with cupric acetate and gallium trichloride, 2.5 g of a 50% by weight solution of a mixture of polyvinyl acetate and a styrene-ethylacrylate copolymer (E041 of De Soto Chemical Company),
0.1 g of a hydrophobic colloidal silica (Aerosyl R972 of Degussa, Frankfurt am Main), and
2.5 ml of toluene.

The dispersion was coated on an electrophotographic paper of which the conductivity was increased by the addition of carbon. The resulting photoconductive element was dried at 120° C and mounted in an indirect electrophotographic copier provided with a magnetic brush developing unit. The copies made with the photoconductive element showed homogeneous image areas whereas a photoconductive element with the same composition but without the hydrophobic colloidal silica delivered copies with grained image areas.

The electrophotographic properties of the elements without and with hydrophobic colloidal silica are shown in Table I.

Table I

| | without silica | with silica |
|---|---|---|
| VO | 30 | 32 |
| V1 | 24 | 27 |
| V5 | 44 | 42 |
| L | 72 | 78 |
| Vr | 2.4 | 1.7 |

The meaning of the symbols is as follows:
VO = the maximum potential in Volts per micron of layer thickness;
V1 = the potential in Volts per micron of layer thickness after 1 second in the dark;
V5 = the dark decay in % of V0 after 5 seconds;
L = the light decay in % of V1 after exposure with 9 lux.seconds;
Vr = the residual potential which cannot be removed by exposure in Volts per micron of layer thickness.

EXAMPLE 2

The dispersions without and with hydrophobic colloidal silica according to Example 1 were coated on a sheet of aluminium and dried at 120° C. The resulting photoconductive elements were mounted in an indirect electrophotographic copier provided with a magnetic brush developing unit. The copies with the photoconductive element according to the invention showed homogeneous image areas whereas the photoconductive element without hydrophobic colloidal silica delivered copies with grained image areas.

The electrophotographic properties of the elements without and with hydrophobic colloidal silica are shown in Table II.

Table II

| | without silica | with silica |
|---|---|---|
| VO | 27 | 32 |
| V1 | 20 | 27 |
| V5 | 43 | 36 |
| L | 77 | 81 |
| Vr | 2.0 | 1.6 |

The meaning of the symbols is as in Example 1.

EXAMPLE 3

A dispersion having the following composition was prepared by mixing
2.5 g of cadmium sulphide doped with cupric acetate and gallium trichloride.
0.75 g of an epoxy resin (Rutapox 0199 of Rutgerswerke AG) dissolved in 0.75 g of a mixture of ethylacetate and toluene 1 : 1,
0.5 g of a benzoguanamine resin dissolved in 0.3 g of butanol (Bakelite 4550 of Bakelite G.m.b.H.),
0.1 g of a hydrophobic colloidal silica (Aerosyl R972 of Degussa, Frankfurt am Main), and
1.9 ml of a mixture of ethylacetate and toluene (7 : 3).

The dispersion was coated on a sheet of aluminium, dried at 120° C for 2 hours and cured at 150° C for 30 minutes. The resulting photoconductive element was mounted in an indirect electrophotographic copier provided with a magnetic brush developing unit. The copies made with the photoconductive element showed homogeneous image areas whereas a photoconductive element with the same composition but without the hydrophobic colloidal silica delivered copies with grained image areas.

In an electrophotographic copier provided with a liquid developer system the photoconductive element according to the invention delivered copies with a toner-free background whereas the photoconductive element without the hydrophobic colloidal silica delivered copies with a toned background.

The electrophotographic properties of the elements without and with hydrophobic colloidal silica are shown in Table III.

Table III

| | without silica | with silica |
|---|---|---|
| VO | 29 | 32 |
| V1 | 26 | 28 |
| V5 | 28 | 26 |
| L | 64 | 86 |
| Vr | 2.0 | 1.4 |

The meaning of the symbols is as in Example 1.

EXAMPLE 4

Four dispersions A, B, C and D having the following compositions were prepared by mixing
2.5 g of cadmium sulphide doped with cupric acetate and gallium trichloride,
0.75 g of an epoxy resin (Rutapox 0199 of Rutgerswerke AG) dissolved in 0.75 g of a mixture of ethyl acetate and toluene 1 : 1,
0.5 g of a benzoguanamine resin dissolved in 0.3 g of butanol (Bakelite 4550 of Bakelite G.m.b.H.), and
1.9 g of a mixture of ethyl acetate and toluene (7 : 3).

The following amounts of hydrophobic colloidal silica (Aerosyl R972 of Degussa) were added to the dispersions:
A : 0 g; C : 0.1 g
B : 0.075 g; D : 0.125 g The dispersions were coated on four sheets of aluminium, dried at 120° C for 2 hours and cured at 150° C for 30 minutes. The electrophotographic properties of the resulting photoconductive elements are shown in Table IV.

Table IV

| | A | B | C | D |
|---|---|---|---|---|
| VO | 30 | 35 | 34 | 35 |
| V1 | 25 | 30 | 30 | 30 |
| V5 | 33 | 31 | 31 | 29 |
| L | 70 | 80 | 81 | 82 |
| Vr | 1.8 | 1.5 | 1.3 | 1.3 |

The meaning of the symbols is as in Example 1.

As shown by Table IV there is no important difference between the samples B, C and D corresponding with photoconductive elements containing between 0.075 and 0.125 g of hydrophobic colloidal silica per 2.5 g of cadmium sulphide. The copies obtained with the samples B, C and D in an indirect electrophotographic copier also did not show important differences whereas the copies obtained with sample A showed a grained image structure.

It is remarkable that all the examples demonstrate that the electrophotographic properties of the photoconductive elements according to the invention are not only considerably improved with respect to the residual voltage but also show a less pronounced improvement with respect to the maximum potential, the dark decay and the light-sensitivity.

We claim:

1. Photoconductive element which comprises a support carrying a photoconductive layer, said layer comprising a photoconductive cadmium compound selected from the group consisting of photoconductive cadmium sulphide, cadmium selenide and cadmium sulphoselenide dispersed in an organic polymeric binder and hydrophobic colloidal silica dispersed therein in an amount sufficient to enhance electrophotographic properties of said layer.

2. Photoconductive element according to claim 1 wherein said layer contains 2 to 6% by weight of hydrophobic colloidal silica calculated on the weight of the cadmium compound.

3. Photoconductive element according to claim 1 wherein the hydrophobic colloidal silica has an average particle size of 7 to 100 nanometer.

4. Photoconductive element according to claim 1, said layer containing by weight 1 to 7 parts of photoconductive cadmium sulphide per part of said binder and 2 to 6% of hydrophobic colloidal silica calculated on the weight of the cadmium sulphide content.

5. Process for producing a copy by electrophotography which process comprises imagewise exposing to light the photoconductive layer of a photoconductive element as claimed in claim 1 and transferring the resulting latent image or a powder image developed on it from said layer to a sheet of receiving material.

* * * * *